US006474483B1

(12) United States Patent
Montoya et al.

(10) Patent No.: US 6,474,483 B1
(45) Date of Patent: Nov. 5, 2002

(54) SHELVING SYSTEMS AND METHODS FOR MANUFACTURING SAME

(75) Inventors: Aldred W. Montoya, Los Angeles, CA (US); Larry J. Bonzoumet, Riverside, CA (US)

(73) Assignee: Paper Solutions Ink, Corp., Fullerton, CA (US)

( * ) Notice: Subject to any disclaimer, the term of this patent is extended or adjusted under 35 U.S.C. 154(b) by 0 days.

(21) Appl. No.: 09/614,522

(22) Filed: Jul. 12, 2000

Related U.S. Application Data

(60) Provisional application No. 60/143,424, filed on Jul. 13, 1999.

(51) Int. Cl.[7] ..... A47F 5/11; A47B 43/02

(52) U.S. Cl. ..... 211/149; 211/195; 248/174; 248/248

(58) Field of Search ..... 211/149, 195, 211/204, 132.1; 248/248, 174

(56) References Cited

U.S. PATENT DOCUMENTS

| | | | | | |
|---|---|---|---|---|---|
| 1,852,471 | A | * | 4/1932 | Nelson | 211/149 X |
| 4,340,251 | A | * | 7/1982 | Geoffroy-Dechaume | 248/174 X |
| 4,488,652 | A | * | 12/1984 | Hinton et al. | 211/149 X |
| 5,632,390 | A | * | 5/1997 | Podergois | 211/149 X |
| 5,680,941 | A | * | 10/1997 | Smith | 211/133.4 |
| 5,706,959 | A | * | 1/1998 | Smith | 211/149 X |
| 5,758,783 | A | * | 6/1998 | Maglione | 211/126.2 |
| 6,098,820 | A | * | 8/2000 | Smith | 211/132.1 |
| 6,135,033 | A | * | 10/2000 | Deferrari | 211/135 X |

* cited by examiner

*Primary Examiner*—Daniel P. Stodola
*Assistant Examiner*—Erica B. Harris
(74) *Attorney, Agent, or Firm*—Foley Hoag LLP

(57) ABSTRACT

A shelving system constructed from paper includes at least one column made from paper that is sufficiently rigid and strong to support an intended object, and at least one shelf supported by the column, which shelf includes a surface on which the intended object may be placed. The column and shelf may be constructed from a sheet of paper designed to be folded into the column and shelf respectively.

13 Claims, 3 Drawing Sheets

SHELVING SYSTEMS AND METHODS FOR MANUFACTURING SAME

RELATED U.S. APPLICATION(S)

The present application claims priority to U.S. Provisional Application Ser. No. 60/143,424, filed Jul. 13, 1999, which is hereby incorporated herein by reference.

TECHNICAL FIELD

The present invention relates to shelving systems, and more particularly to modular shelving units constructed from corrugated paper.

BACKGROUND ART

Presently, many shelving units or systems are commercially available. These shelving units or systems are typically manufactured using wooden, metal, and/or plastic components, and once assembled, are convenient to use. However, the assembly of these units or systems can be time consuming and, at times, difficult to carry out. Moreover, the costs associated with the manufacturing of these units or systems can be expensive. As a result, the costs of buying these shelving units or systems can be prohibitively high to consumers.

To avoid the costs associated with buying a manufactured shelving unit or system, home-made shelving units have been utilized by many creative individuals. For instance, milk crates have been used alone or in conjunctions with wooden boards in the construction of shelf space. Other individuals have utilized concrete blocks with wooden boards to create shelf space for similar purposes. The costs associated with the use of these components in a home-made shelving unit or system can be reasonable, if the components are readily and/or freely available. However, when such components are not freely available, the individual must spend a sometime hefty amount to purchase such components.

Accordingly, it is desirable to provide a shelving unit or system which is economical and easy to assemble.

SUMMARY OF THE INVENTION

The present invention, in accordance with one embodiment, provides a shelving system comprising at least one column made from paper sufficiently strong, so as to support an intended object. The paper from which the column may be made includes a sheet designed to be folded into a column having a predetermined cross-sectional geometric shape. The geometric shape of the column provides the column with an ability to be free standing. The sheet of paper may further include a tuck joint or a glued joint to permit the column to maintain its geometric shape. In one embodiment, the column may be made from corrugated paper. The system further includes at least one shelf supported by the column to provide a surface on which the intended object may be placed. To support the shelf, the column may be provided with an aperture through which the shelf may be placed. The shelf may include a cross-sectional shape which compliments the shape of the aperture to permit a close fitting engagement between the shelf and the aperture.

In accordance with another embodiment, a method of manufacturing a shelving system is provided. The method includes providing a sheet of paper sufficiently strong to act as a column upon which a shelf and an intended object may be supported. Next, a plurality of scores on the sheet of paper is created to permit the paper to be folded into a three-dimensional column. Thereafter, the sheet of paper may be die cut, such that when the sheet of paper is folded into a column, a predetermined geometric shape is achieved.

In accordance with another embodiment, a method for supporting an object is provided. The method includes providing at least one column made from paper sufficiently strong to support the object. Then, at least one shelf having a surface on which the object may be placed is secured to the column. Subsequently, the object is placed on the surface of the shelf.

The present invention also provides in a further embodiment, a shelving unit kit having a first sheet of paper designed to be folded into a shelf that is sufficiently strong to support an intended object. The kit also includes a second sheet of paper designed to be folded into a free standing column of a geometric shape. The second sheet, in one embodiment, is provided with opposing apertures to permit the shelf, made from the first sheet, to extend therethrough once the second sheet is folded into the column.

DESCRIPTION OF THE INVENTION

Figure 1:
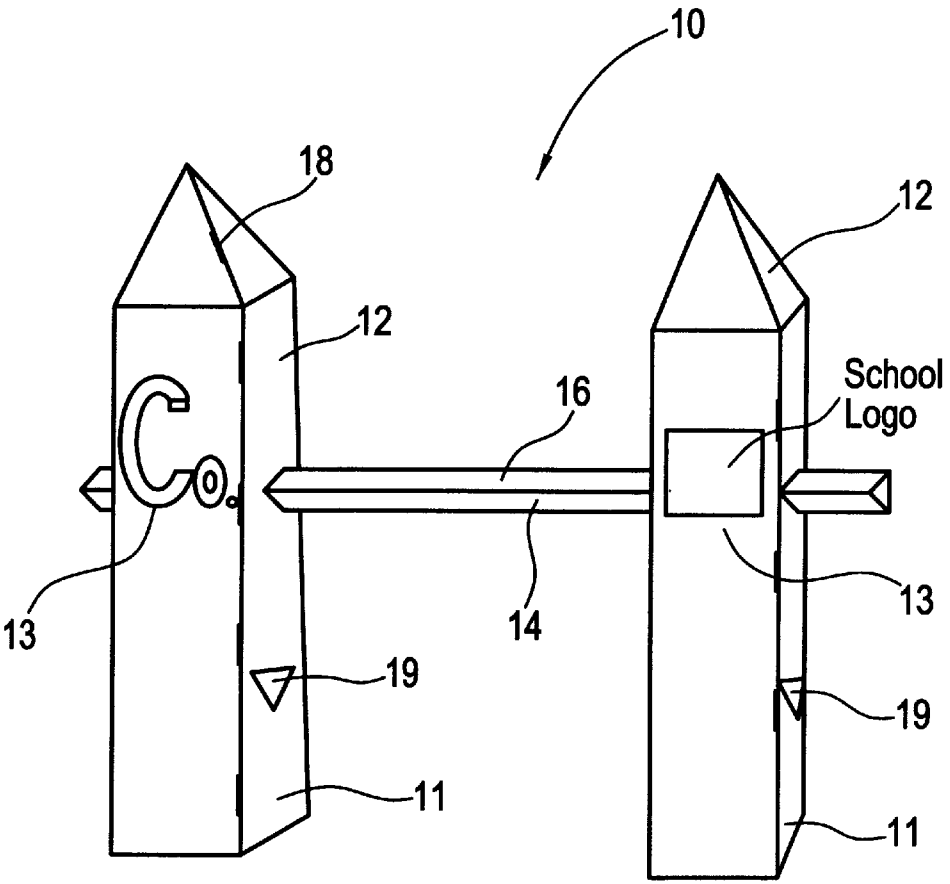
FIG. 1 illustrates a shelving system in accordance with an embodiment of the present invention.

In accordance with one embodiment of the invention, a shelving system 10 is shown in FIG. 1. The shelving system 10 includes at least one column 12 made from paper that is sufficiently rigid and strong to support an intended object, and at least one shelf 14 supported by the column 12 to provide a surface 16 on which the intended object may be placed. The paper from which the column 12 is made includes corrugated paper, but can be made from any paper, for instance, Kraft paper, that is sufficiently rigid and strong for support purposes. The column 12, in one embodiment, can be constructed from a sheet of paper (a detailed description of which is provided hereinafter) designed to be folded into a column having a predetermined geometric shape. An example of such a geometric shape can be seen in FIG. 1. It should be understood that although only one shape is shown in FIG. 1, the geometric shape for the column 12 can be in any form, shape or design. Moreover, the column 12 may include ornamental designs, decorations or logos 13 on or cut (i.e., die cut) in any of the surfaces of the column 12.

The sheet of paper from which the column 12 is folded preferably includes at least one tuck joint 18 to permit the column 12 to maintain its geometric shape. Other types of joints known in the art may also be used, for example, glued joints. Looking now at FIG. 2A, when folded the column 12 includes a cross section 20 of a geometric shape, for instance a square. The geometric shape of the cross section 20 is preferably sufficient to permit the column 12 to be free standing. Examples of cross sectional shapes include, but are not limited to, a parallelogram, a triangle, a circle or any shape which provides the column 12 with a base 11 to permit the column to be free standing.

Referring again to FIG. 1, the column 12 can be designed to include an aperture 19 through which the shelf 14 may be supported. In a preferred embodiment, opposing apertures 19 are provided, so that the shelf 14 may extend completely through the column 12. It will be appreciated that the shelf 14 should have a cross sectional shape that will not hinder the extension of the shelf 14 across the aperture 19. Rather, the shape of the shelf 14 should permit to shelf 14 to extend completely across the aperture 19. In one embodiment, the shelf 14 is provided with a cross sectional shape which compliments the shape of the aperture 19, so as to permit a close fitting engagement between the shelf 14 and the aperture 19.

Figure 2B:
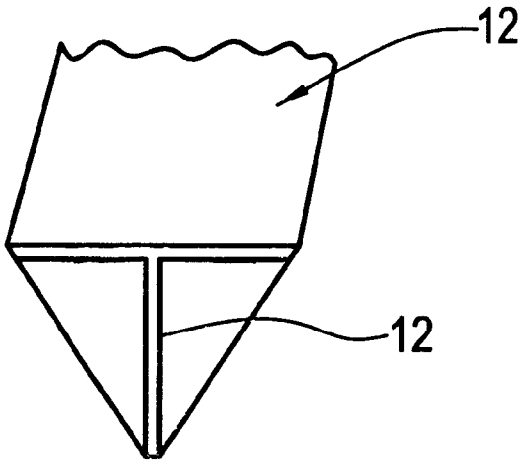
FIGS. 2A–B are respective end views of a column and a shelf for use in accordance with an embodiment of the invention.
Figure 2A:
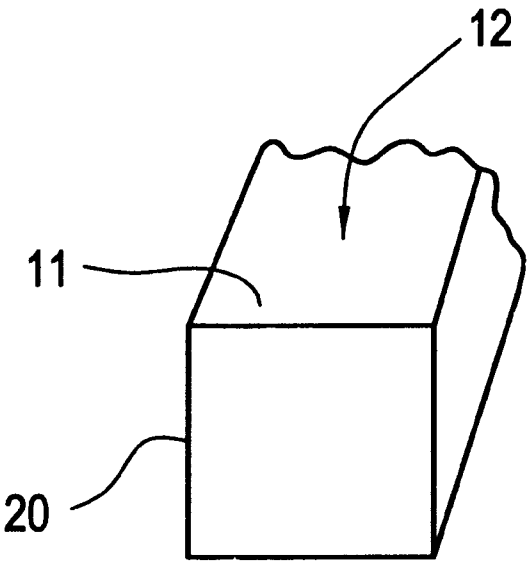

The shelf 14, like the column 12, can be constructed from paper sufficiently rigid and strong to support the intended object. Such paper includes corrugated paper or Kraft paper. Also like column 12, the paper from which the shelf 14 is made includes a sheet designed to be folded into a predetermined geometric shape. In one embodiment, the cross sectional shape of the shelf 14 includes a triangle which is folded back into itself to provide a T-shape support 17, as shown in FIG. 2B, along the length of the shelf 14. By providing the shelf 14 with support 17, added strength can be given to the entire shelf 14. Of course other cross section designs may also be employed. However one should keep in mind that such designs should take into account the rigidity and strength needed by the shelf 14 to support an intended object. In addition to corrugated paper, the shelf 14 of the present invention can also be constructed from other materials such as wood, plastic, metal, hard rubber, or any material, so long as such materials are sufficiently rigid and strong to support the intended object.

Figure 3B:
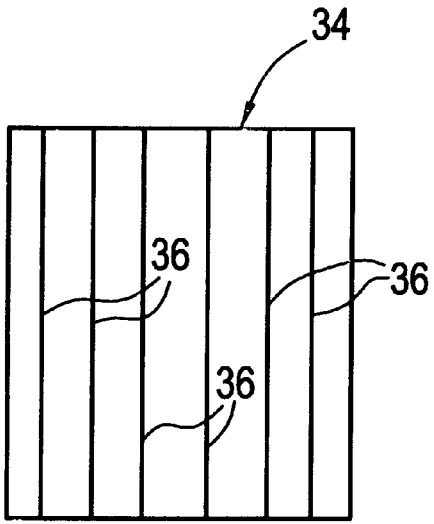
FIGS. 3A–B illustrate sheets of paper from which the column and shelf may be folded in accordance with one embodiment of the present invention.
Figure 3A:
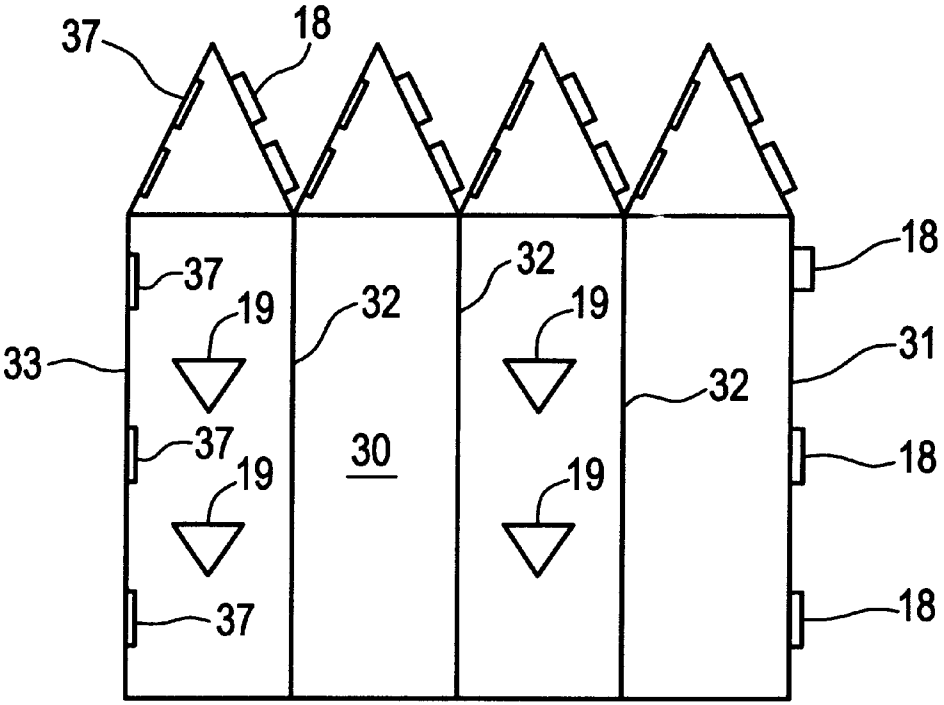

With reference now to FIG. 3, the shelving system 10 of the present invention may be manufactured by initially providing a sheet of paper 30 that is sufficiently rigid and strong to act as a column upon which a shelf and an intended object may be supported. Subsequently, a plurality of scores 32 (i.e., creases) may be created on the sheet of paper 30 to permit the paper to be folded into a three dimensional column. The sheet of paper 30, thereafter may be die cut with a pattern, such that when the sheet of paper 30 is folded into a column, a predefined geometric shape is achieved. It should be noted that when the sheet of paper 30 is die cut, aperture 19 may also be cut into the sheet to subsequently permit the extension and securing of a shelf therethrough. In one embodiment edges 31 and 33 may be provided with tuck joints 18 and corresponding openings 37 to permit the column to maintain its shape once folded. Alternatively, the edges 31 and 33 may be bonded together by adhesives or other well know bonding compounds.

A second sheet of paper 34 may also be provided from which a shelf may be folded. The sheet 34 should be sufficiently strong to support an intended object. The sheet 34 may be provided with scores 36, such that when the sheet is folded into a shelf, a surface is generated on which the intended object may be placed.

The sheet 30 from which a column may be folded and the sheet 34 from which the shelf may be folded can be packaged together as a kit which a consumer may purchase and assemble into a shelving system 10 in accordance with an embodiment of the present invention. The assembly of the system 10 from the kit requires the sheet 30 to be folded along the scores 32 into the shape of a column, such as column 12. Such column may maintain its shape by inserting tuck joints 18 into a corresponding opening 37. If the edges 31 and 33 of the sheet 30 were instead bonded together, all that is necessary is pull the surfaces and/or sides of the column away from one another, since the surfaces and/or sides were packaged flat against one another. Once the column is created, the sheet 34 is folded along its scores 36 into the shape of a shelf, such as shelf 14. Such a shelf thereafter can be extended across the aperture in the column to complete the assembly of the shelving unit.

While the invention has been described in connection with the specific embodiments thereof, it will be understood that it is capable of further modification. For example, multiple columns may be provided, as well as multiple shelves. In such a situation, each column may be provided with a plurality of apertures for accommodating the additional shelves. Moreover, should it be desirable to enhance the aesthetic appearance of the shelving system, the columns, including the shelves, may be provided with various patterns, colors, logos or designs. Furthermore, this application is intended to cover any variations, uses, or adaptations of the invention, including such departures from the present disclosure as come within known or customary practice in the art to which the invention pertains, and as fall within the scope of the appended claims.

What is claimed is:

1. A shelving system comprising:

at least one column made from paper to support an intended object, the column having opposing apertures;

at least one shelf supported by the column and extending across the opposing apertures through to provide a surface on which the intended object may be placed, wherein the paper includes a sheet having at least one of the following, a tuck joint and a glued joint, to permit the column to maintain a geometric shape.

2. A shelving system as set forth in claim 1, wherein the paper from which the column is made includes corrugated paper.

3. A shelving system as set forth in claim 1, wherein the sheet is designed to be folded into a column.

4. A shelving system as set forth in claim 1, wherein the column includes a cross section defined by a geometric shape.

5. A shelving unit as set forth in claim 4, wherein the geometric shape of the cross section is sufficient to permit the column to be free standing.

6. A shelving system as set forth in claim 1, wherein the column includes a cross section in a shape of a parallelogram.

7. A shelving system as set forth in claim 1, wherein the column includes a triangular cross section.

8. A shelving system as set forth in claim 1, wherein the shelf includes a cross sectional shape to permit the shelf to extend across the opposing apertures.

9. A shelving system as set forth in claim 8, wherein the cross sectional shape of the shelf complements that of the aperture to permit a close fitting engagement.

10. A shelving system as set forth in claim 1, wherein the shelf is constructed from paper.

11. A shelving system as set forth in claim 10, wherein the paper from which the shelf is made includes corrugated paper.

12. A shelving system as set forth in claim 10, wherein the paper from which the shelf is made includes a sheet designed to be folded into a predetermined geometric shape.

13. A shelving system as set forth in claim 1, wherein the shelf is constructed from one of wood, plastic, metal and hard rubber.

* * * * *